US008439769B2

(12) United States Patent
Rice et al.

(10) Patent No.: US 8,439,769 B2
(45) **Date of Patent: *May 14, 2013**

(54) METAL WOOD CLUB WITH IMPROVED HITTING FACE

(75) Inventors: Scott A. Rice, San Diego, CA (US); Joshua G. Breier, Vista, CA (US)

(73) Assignee: Acushnet Company, Fairhaven, MA (US)

( * ) Notice: Subject to any disclaimer, the term of this patent is extended or adjusted under 35 U.S.C. 154(b) by 503 days.

This patent is subject to a terminal disclaimer.

(21) Appl. No.: 12/760,773

(22) Filed: Apr. 15, 2010

(65) Prior Publication Data

US 2010/0255930 A1 Oct. 7, 2010

Related U.S. Application Data

(63) Continuation-in-part of application No. 12/487,676, filed on Jun. 19, 2009, now Pat. No. 7,762,907, which is a continuation-in-part of application No. 11/221,221, filed on Sep. 7, 2005, now Pat. No. 7,704,162.

(51) Int. Cl.
*A63B 53/04* (2006.01)

(52) U.S. Cl.
USPC ..... 473/329; 473/345; 473/346; 473/349

(58) Field of Classification Search ..... 473/324–350, 473/287–292
See application file for complete search history.

(56) References Cited

U.S. PATENT DOCUMENTS

| | | | |
|---|---|---|---|
| 1,318,325 | A | 10/1919 | Klin |
| 1,319,233 | A | 10/1919 | Mattern |
| 1,467,435 | A | 9/1923 | Kinnear |
| 1,525,352 | A | 2/1925 | Aitken |
| 1,543,691 | A | 6/1925 | Beat |
| 1,582,836 | A | 4/1926 | Link |
| 1,589,363 | A | 6/1926 | Butchart |
| 1,595,589 | A | 8/1926 | Tyler |
| 1,605,551 | A | 11/1926 | Mattern |
| 1,699,874 | A | 1/1929 | Buhrke |

(Continued)

FOREIGN PATENT DOCUMENTS

| | | |
|---|---|---|
| CN | 1114911 | 1/1996 |
| GB | 2268693 A | 1/1994 |

(Continued)

OTHER PUBLICATIONS

Golf Digest, Sep. 1982, p. 25.

(Continued)

*Primary Examiner* — Sebastiano Passaniti
(74) *Attorney, Agent, or Firm* — Randy K. Chang

(57) ABSTRACT

A hitting face of a golf club head having a location of longest characteristic time shifted away from the geometric center of the hitting face. The hitting face of the club head has varying thickness, with a thickest portion being at or near the geometric center of the plate-like hitting face. A second thickened portion of the hitting face substantially surrounds the thickest portion. The portions of varying thickness taper therebetween for relatively smooth cross-sectional profiles. The hitting face may further comprise a plurality of indentations at least partially located within the outer intermediate zone of the hitting face, having a thickness that is less than the thickness of the hitting face at the geometric center and tapered portion.

22 Claims, 9 Drawing Sheets

U.S. PATENT DOCUMENTS

| | | | | |
|---|---|---|---|---|
| 1,704,119 | A | | 3/1929 | Buhrke |
| 1,704,165 | A | | 3/1929 | Buhrke |
| 1,720,867 | A | | 7/1929 | Webster et al. |
| 2,034,936 | A | | 3/1936 | Barnhart |
| 2,087,685 | A | | 7/1937 | Hackney |
| 3,567,228 | A | | 3/1971 | Lynn |
| 3,571,900 | A | | 3/1971 | Hardesty |
| 3,625,518 | A | | 12/1971 | Solheim |
| 3,659,855 | A | | 5/1972 | Hardesty |
| 3,863,932 | A | | 2/1975 | Lezatte |
| 3,985,363 | A | | 10/1976 | Jepson et al. |
| 4,023,802 | A | | 5/1977 | Jepson et al. |
| 4,193,601 | A | | 3/1980 | Reid, Jr. et al. |
| 4,213,613 | A | | 7/1980 | Nygren |
| 4,214,754 | A | | 7/1980 | Zebelean |
| D267,965 | S | | 2/1983 | Kobayashi |
| 4,429,879 | A | | 2/1984 | Schmidt |
| 4,432,549 | A | | 2/1984 | Zebelean |
| 4,449,707 | A | | 5/1984 | Hayashi et al. |
| 4,451,041 | A | | 5/1984 | Hayashi et al. |
| 4,451,042 | A | | 5/1984 | Hayashi et al. |
| 4,465,221 | A | | 8/1984 | Schmidt |
| 4,471,961 | A | | 9/1984 | Masghati et al. |
| 4,489,945 | A | | 12/1984 | Kobayashi |
| 4,511,145 | A | | 4/1985 | Schmidt |
| 4,762,324 | A | | 8/1988 | Anderson |
| 4,792,140 | A | | 12/1988 | Yamaguchi et al. |
| 4,826,172 | A | | 5/1989 | Antonious |
| 4,842,243 | A | | 6/1989 | Butler |
| 4,913,438 | A | | 4/1990 | Anderson |
| 4,915,385 | A | | 4/1990 | Anderson |
| 4,915,386 | A | | 4/1990 | Antonious |
| 4,919,430 | A | | 4/1990 | Antonious |
| 4,919,431 | A | | 4/1990 | Antonious |
| 4,921,252 | A | | 5/1990 | Antonious |
| 4,928,965 | A | | 5/1990 | Yamaguchi et al. |
| 4,930,781 | A | | 6/1990 | Allen |
| 4,932,658 | A | | 6/1990 | Antonious |
| 4,955,610 | A | | 9/1990 | Creighton et al. |
| D312,858 | S | | 12/1990 | Anderson et al. |
| 5,000,454 | A | | 3/1991 | Soda |
| 5,024,437 | A | | 6/1991 | Anderson |
| 5,028,049 | A | | 7/1991 | McKeighen |
| 5,046,733 | A | | 9/1991 | Antonious |
| 5,056,705 | A | | 10/1991 | Wakita et al. |
| 5,060,951 | A | | 10/1991 | Allen |
| 5,067,715 | A | | 11/1991 | Schmidt et al. |
| 5,090,702 | A | | 2/1992 | Viste |
| 5,094,383 | A | | 3/1992 | Anderson et al. |
| 5,106,094 | A | | 4/1992 | Desbiolles et al. |
| 5,141,230 | A | | 8/1992 | Antonious |
| 5,163,682 | A | | 11/1992 | Schmidt et al. |
| 5,180,166 | A | | 1/1993 | Schmidt et al. |
| 5,183,255 | A | | 2/1993 | Antonious |
| 5,213,328 | A | | 5/1993 | Long et al. |
| 5,221,087 | A | | 6/1993 | Fenton et al. |
| 5,240,252 | A | | 8/1993 | Schmidt et al. |
| 5,242,167 | A | | 9/1993 | Antonious |
| 5,255,918 | A | | 10/1993 | Anderson et al. |
| 5,261,663 | A | | 11/1993 | Anderson |
| 5,261,664 | A | | 11/1993 | Anderson |
| 5,271,621 | A | | 12/1993 | Lo |
| 5,282,624 | A | * | 2/1994 | Viste ..... 473/342 |
| 5,292,129 | A | | 3/1994 | Long et al. |
| 5,295,689 | A | | 3/1994 | Lundberg |
| 5,301,945 | A | | 4/1994 | Schmidt et al. |
| 5,318,300 | A | | 6/1994 | Schmidt et al. |
| 5,328,184 | A | | 7/1994 | Antonious |
| 5,344,140 | A | | 9/1994 | Anderson |
| 5,346,218 | A | | 9/1994 | Wyte |
| 5,351,958 | A | | 10/1994 | Helmstetter |
| 5,358,249 | A | | 10/1994 | Mendralla |
| 5,362,047 | A | | 11/1994 | Shaw et al. |
| 5,362,055 | A | | 11/1994 | Rennie |
| 5,366,223 | A | | 11/1994 | Werner et al. |
| 5,380,010 | A | | 1/1995 | Werner et al. |
| 5,390,924 | A | | 2/1995 | Antonious |
| 5,395,113 | A | | 3/1995 | Antonious |
| 5,397,126 | A | | 3/1995 | Allen |
| 5,401,021 | A | | 3/1995 | Allen |
| 5,405,136 | A | | 4/1995 | Hardman |
| 5,405,137 | A | | 4/1995 | Vincent et al. |
| 5,407,202 | A | | 4/1995 | Igarashi |
| RE34,925 | E | | 5/1995 | McKeighen |
| 5,417,419 | A | | 5/1995 | Anderson et al. |
| 5,417,559 | A | | 5/1995 | Schmidt |
| 5,423,535 | A | | 6/1995 | Shaw et al. |
| 5,429,357 | A | | 7/1995 | Kobayashi |
| 5,431,396 | A | | 7/1995 | Shieh |
| 5,433,440 | A | | 7/1995 | Lin |
| 5,447,307 | A | | 9/1995 | Antonious |
| 5,447,309 | A | | 9/1995 | Vincent |
| 5,451,056 | A | | 9/1995 | Manning |
| 5,460,376 | A | | 10/1995 | Schmidt et al. |
| 5,467,983 | A | | 11/1995 | Chen |
| 5,470,069 | A | | 11/1995 | Schmidt et al. |
| 5,474,296 | A | | 12/1995 | Schmidt et al. |
| 5,482,279 | A | | 1/1996 | Antonious |
| 5,497,993 | A | | 3/1996 | Shan |
| 5,505,453 | A | | 4/1996 | Mack |
| 5,522,593 | A | | 6/1996 | Kobayashi et al. |
| 5,524,331 | A | | 6/1996 | Pond |
| 5,533,729 | A | | 7/1996 | Leu |
| 5,536,006 | A | | 7/1996 | Shieh |
| 5,547,630 | A | | 8/1996 | Schmidt |
| 5,549,297 | A | | 8/1996 | Mahaffey |
| 5,564,994 | A | | 10/1996 | Chang |
| 5,584,770 | A | | 12/1996 | Jensen |
| 5,595,552 | A | | 1/1997 | Wright et al. |
| 5,611,741 | A | | 3/1997 | Schmidt et al. |
| 5,611,742 | A | | 3/1997 | Kobayashi |
| D379,393 | S | | 5/1997 | Kubica et al. |
| 5,626,530 | A | | 5/1997 | Schmidt et al. |
| 5,643,104 | A | | 7/1997 | Antonious |
| 5,643,108 | A | | 7/1997 | Cheng |
| 5,643,110 | A | | 7/1997 | Igarashi |
| 5,649,872 | A | | 7/1997 | Antonious |
| 5,651,409 | A | | 7/1997 | Sheehan |
| 5,655,976 | A | | 8/1997 | Rife |
| 5,665,013 | A | * | 9/1997 | Kobayashi ..... 473/331 |
| 5,669,827 | A | | 9/1997 | Nagamoto |
| 5,669,829 | A | | 9/1997 | Lin |
| 5,674,132 | A | | 10/1997 | Fisher |
| 5,676,605 | A | * | 10/1997 | Kobayashi ..... 473/331 |
| D387,113 | S | | 12/1997 | Burrows |
| 5,695,411 | A | | 12/1997 | Wright et al. |
| 5,709,614 | A | | 1/1998 | Horiba |
| 5,709,615 | A | | 1/1998 | Liang |
| 5,711,722 | A | | 1/1998 | Miyajima et al. |
| 5,716,292 | A | | 2/1998 | Huang |
| 5,718,641 | A | | 2/1998 | Lin |
| 5,720,673 | A | | 2/1998 | Anderson |
| 5,743,813 | A | | 4/1998 | Chen et al. |
| 5,753,170 | A | | 5/1998 | Muang |
| 5,755,624 | A | | 5/1998 | Helmstetter |
| 5,755,627 | A | | 5/1998 | Yamazaki |
| 5,762,567 | A | | 6/1998 | Antonious |
| 5,766,092 | A | | 6/1998 | Mimeur et al. |
| 5,766,094 | A | | 6/1998 | Mahaffey et al. |
| 5,766,095 | A | | 6/1998 | Antonious |
| 5,776,011 | A | | 7/1998 | Su et al. |
| 5,807,190 | A | | 9/1998 | Krumme et al. |
| 5,827,132 | A | | 10/1998 | Bamber |
| RE35,955 | E | | 11/1998 | Lu |
| D401,652 | S | | 11/1998 | Burrows |
| 5,830,084 | A | | 11/1998 | Kosmatka |
| 5,839,975 | A | | 11/1998 | Lundberg |
| 5,842,934 | A | | 12/1998 | Ezaki et al. |
| 5,851,159 | A | | 12/1998 | Burrows |
| 5,863,261 | A | | 1/1999 | Eggiman |
| 5,873,791 | A | | 2/1999 | Allen |
| 5,873,795 | A | | 2/1999 | Wozny et al. |
| D406,294 | S | | 3/1999 | Burrows |
| 5,888,148 | A | | 3/1999 | Allen |
| 5,890,973 | A | | 4/1999 | Gamble |
| D411,272 | S | | 6/1999 | Burrows |
| 5,908,357 | A | | 6/1999 | Hsieh |

| | | | | |
|---|---|---|---|---|
| 5,921,872 | A | 7/1999 | Kobayashi | |
| 5,931,746 | A | 8/1999 | Soong | |
| 5,935,019 | A | 8/1999 | Yamamoto | |
| 5,938,541 | A | 8/1999 | Allen et al. | |
| 5,941,782 | A | 8/1999 | Cook | |
| 5,944,619 | A | 8/1999 | Cameron | |
| 5,954,596 | A | 9/1999 | Noble et al. | |
| D415,807 | S | 10/1999 | Werner et al. | |
| 5,961,394 | A | 10/1999 | Minabe | |
| 5,967,905 | A | 10/1999 | Nakahara et al. | |
| 5,971,868 | A | 10/1999 | Kosmatka | |
| 5,993,329 | A | 11/1999 | Shieh | |
| 5,993,331 | A * | 11/1999 | Shieh | 473/342 |
| 6,007,432 | A | 12/1999 | Kosmatka | |
| D418,887 | S * | 1/2000 | Williams, Jr. | D21/749 |
| 6,027,416 | A | 2/2000 | Schmidt et al. | |
| 6,139,445 | A | 10/2000 | Werner et al. | |
| 6,152,833 | A | 11/2000 | Werner et al. | |
| 6,248,025 | B1 | 6/2001 | Murphy | |
| 6,299,548 | B1 * | 10/2001 | Lin | 473/331 |
| 6,319,150 | B1 | 11/2001 | Werner et al. | |
| 6,338,683 | B1 | 1/2002 | Kosmatka | |
| 6,354,962 | B1 | 3/2002 | Galloway | |
| 6,368,234 | B1 | 4/2002 | Galloway | |
| 6,381,828 | B1 | 5/2002 | Boyce | |
| 6,390,933 | B1 | 5/2002 | Galloway | |
| 6,398,666 | B1 | 6/2002 | Evans et al. | |
| 6,435,982 | B1 | 8/2002 | Galloway et al. | |
| 6,605,007 | B1 | 8/2003 | Bissonnette et al. | |
| 6,652,391 | B1 * | 11/2003 | Kubica et al. | 473/345 |
| 6,679,786 | B2 * | 1/2004 | McCabe | 473/305 |
| 6,899,638 | B2 | 5/2005 | Iwata et al. | |
| 6,904,663 | B2 * | 6/2005 | Willett et al. | 29/557 |
| 7,018,303 | B2 * | 3/2006 | Yamamoto | 473/329 |
| 7,029,403 | B2 * | 4/2006 | Rice et al. | 473/329 |
| 7,066,833 | B2 * | 6/2006 | Yamamoto | 473/330 |
| 7,207,898 | B2 * | 4/2007 | Rice et al. | 473/329 |
| 7,220,190 | B2 * | 5/2007 | Hirano | 473/342 |
| 7,226,366 | B2 | 6/2007 | Galloway et al. | |
| 7,258,626 | B2 * | 8/2007 | Gibbs et al. | 473/329 |
| 7,261,643 | B2 * | 8/2007 | Rice et al. | 473/329 |
| 7,278,925 | B2 * | 10/2007 | Oyama | 473/329 |
| 7,331,877 | B2 * | 2/2008 | Yamaguchi et al. | 473/329 |
| 7,361,099 | B2 * | 4/2008 | Rice et al. | 473/329 |
| 7,442,132 | B2 * | 10/2008 | Nishio | 473/342 |
| 7,494,426 | B2 * | 2/2009 | Nishio et al. | 473/350 |
| 7,520,819 | B2 * | 4/2009 | Rice et al. | 473/329 |
| 7,549,934 | B2 * | 6/2009 | Rice | 473/329 |
| 7,575,524 | B2 * | 8/2009 | Willett et al. | 473/342 |
| 7,578,755 | B2 * | 8/2009 | Oyama | 473/342 |
| 7,614,964 | B2 * | 11/2009 | Matsunaga | 473/342 |
| 7,618,331 | B2 * | 11/2009 | Hirano | 473/329 |
| 7,704,162 | B2 * | 4/2010 | Rice et al. | 473/329 |
| 7,762,907 | B2 * | 7/2010 | Rice | 473/329 |
| 7,794,335 | B2 * | 9/2010 | Cole et al. | 473/342 |
| 7,980,963 | B2 * | 7/2011 | Rice et al. | 473/329 |
| 8,025,590 | B2 * | 9/2011 | Rice et al. | 473/329 |
| 8,038,544 | B2 * | 10/2011 | Meyer et al. | 473/314 |
| 8,262,502 | B2 * | 9/2012 | Rice et al. | 473/329 |
| 2002/0082117 | A1 * | 6/2002 | Nishitani et al. | 473/345 |
| 2003/0064823 | A1 * | 4/2003 | Yamamoto | 473/329 |
| 2003/0144080 | A1 * | 7/2003 | Yoneyama | 473/349 |
| 2004/0204263 | A1 * | 10/2004 | Fagot et al. | 473/291 |
| 2005/0003901 | A1 * | 1/2005 | Kuroda et al. | 473/324 |
| 2005/0137029 | A1 * | 6/2005 | Evans et al. | 473/342 |
| 2006/0079347 | A1 * | 4/2006 | Gibbs et al. | 473/345 |
| 2007/0066420 | A1 * | 3/2007 | Imamoto et al. | 473/329 |
| 2008/0004129 | A1 * | 1/2008 | Lin et al. | 473/332 |
| 2008/0039227 | A1 * | 2/2008 | Schweigert et al. | 473/329 |
| 2010/0105501 | A1 * | 4/2010 | Wada et al. | 473/346 |
| 2010/0255929 | A1 * | 10/2010 | Soracco et al. | 473/329 |
| 2011/0201451 | A1 * | 8/2011 | Wada et al. | 473/346 |

FOREIGN PATENT DOCUMENTS

| | | |
|---|---|---|
| GB | 2331938 A | 6/1999 |
| JP | 59207169 | 11/1984 |
| JP | 61033682 | 2/1986 |
| JP | 61162967 | 7/1986 |
| JP | 61181477 | 8/1986 |
| JP | 61185281 | 8/1986 |
| JP | 61240977 | 10/1986 |
| JP | 1244770 | 9/1989 |
| JP | 02130519 | 5/1990 |
| JP | 4020357 | 1/1992 |
| JP | 4327864 | 11/1992 |
| JP | 5212526 | 8/1993 |
| JP | 05237207 | 9/1993 |
| JP | 6007487 | 1/1994 |
| JP | 06031016 | 2/1994 |
| JP | 6114126 | 4/1994 |
| JP | 6126002 | 5/1994 |
| JP | 6154367 | 6/1994 |
| JP | 6182005 | 7/1994 |
| JP | 6269518 | 9/1994 |
| JP | 8168541 | 7/1996 |
| JP | 8243194 | 9/1996 |
| JP | 8280853 | 10/1996 |
| JP | 8280854 | 10/1996 |
| JP | 8294550 | 11/1996 |
| JP | 9028842 | 2/1997 |
| JP | 9047531 | 2/1997 |
| JP | 9154985 | 6/1997 |
| JP | 9168613 | 6/1997 |
| JP | 9192270 | 7/1997 |
| JP | 9192273 | 7/1997 |
| JP | 9239074 | 9/1997 |
| JP | 9239075 | 9/1997 |
| JP | 9248353 | 9/1997 |
| JP | 9294833 | 11/1997 |
| JP | 9299519 | 11/1997 |
| JP | 10024126 | 1/1998 |
| JP | 10024128 | 1/1998 |
| JP | 10085369 | 4/1998 |
| JP | 10118227 | 5/1998 |
| JP | 10137372 | 5/1998 |
| JP | 10155943 | 6/1998 |
| JP | 10258142 | 9/1998 |
| JP | 10263121 | 10/1998 |
| JP | 10323410 | 12/1998 |
| JP | 10337347 | 12/1998 |

OTHER PUBLICATIONS

Golf Digest, Dec. 1981, p. 58-59.

"Variable Face Thickness Technology," Calloway Golf advertisement, undated.

* cited by examiner

METAL WOOD CLUB WITH IMPROVED HITTING FACE

CROSS-REFERENCE TO RELATED APPLICATION

The present application is a continuation-in-part of U.S. patent application Ser. No. 12/487,676, filed on Jun. 19, 2009 now U.S. Pat. No. 7,762,907, which is a continuation of U.S. Pat. No. 7,549,934, filed on Aug. 4, 2006, which is a continuation-in-part of U.S. patent application Ser. No. 11/221,221 filed on Sep. 7, 2005 now U.S. Pat. No. 7,704,162, the disclosures of which are hereby incorporated herein by reference in their entirety.

BACKGROUND

The present invention relates to an improved golf club head. More particularly, the present invention relates to a golf club head with an improved striking face having the longest characteristic time shifted away from the geometric center of the hitting face.

The complexities of golf club design are well known. The specifications for each component of the club (i.e., the club head, shaft, grip, and subcomponents thereof) directly impact the performance of the club. Thus, by varying the design specifications, a golf club can be tailored to have specific performance characteristics.

The design of club heads has long been studied. Among the more prominent considerations in club head design are loft, lie, face angle, horizontal face bulge, vertical face roll, center of gravity, inertia, material selection, and overall head weight. While this basic set of criteria is generally the focus of golf club engineering, several other design aspects are also often addressed. The interior design of the club head may be tailored to achieve particular characteristics, such as the inclusion of hosel or shaft attachment means, perimeter weights on the club head, and fillers within hollow club heads.

Golf club heads are also sufficiently strong to withstand the repeated impacts that occur during collisions between the golf club and the golf ball. The loading that occurs during this transient event can create a peak force of over 2,000 lbs. Thus, a major challenge is designing the club face and body to resist permanent deformation or failure by material yield or fracture. Conventional hollow metal wood drivers made from titanium typically have a uniform face thickness exceeding 2.5 mm to ensure structural integrity of the club head.

Players generally seek a metal wood driver and golf ball combination that delivers maximum distance and landing accuracy. The distance a ball travels after impact is dictated by the magnitude and direction of the ball's translational velocity and the ball's rotational velocity or spin. Environmental conditions, including atmospheric pressure, humidity, temperature, and wind speed further influence the ball's flight. However, these environmental effects are beyond the control of the golf equipment manufacturer. Golf ball landing accuracy is driven by a number of factors as well. Some of these factors are attributed to club head design, such as center of gravity and club face flexibility.

Generally, golf ball travel distance is a function of the total kinetic energy imparted to the ball during impact with the club head, neglecting environmental effects. During impact, kinetic energy is transferred from the club and stored as elastic strain energy in the club head and as viscoelastic strain energy in the ball. After impact, the stored energy in the ball and in the club is transformed back into kinetic energy in the form of translational and rotational velocity of the ball, as well as the club. Since the collision is not perfectly elastic, a portion of energy is dissipated in club head vibration and in viscoelastic relaxation of the ball. Viscoelastic relaxation is a material property of the polymeric materials used in most commercially-available golf balls.

Viscoelastic relaxation of the ball is a parasitic energy source, which is dependent upon the rate of deformation of the ball. To minimize this effect, the rate of deformation of the ball should be reduced. This may be accomplished by allowing more club face deformation during impact which increases the duration of contact between the ball and the club face. Since metallic deformation may be purely elastic, the strain energy stored in the club face is returned to the ball after impact thereby increasing the ball's outbound velocity after impact.

A variety of techniques may be utilized to vary the deformation of the club face, including uniform face thinning, thinned faces with ribbed stiffeners and varying thickness, among others. These designs should have sufficient structural integrity to withstand repeated impacts without permanently deforming the club face. In general, conventional club heads also exhibit wide variations in initial ball speed after impact, depending on the impact location on the face of the club.

The United States Golf Association (USGA), the governing body for the rules of golf in the United States, issues specifications for the performance of golf balls and clubs. One such USGA rule limits the duration of the contact between the golf ball and the geometrical center of a club face, called the "characteristic time", to less than 257 microseconds. To maximize golf ball travel distance, a golf club's spring-like effect should be maximized while remaining within these rules. Hence, there remains a need in the art for a club head that has maximized performance in terms of carry distance and club face deformation while adhering to USGA characteristic time rules at the geometric center of the hitting face.

SUMMARY OF THE INVENTION

A golf club head comprising a hitting face having a central zone and an intermediate zone. The central zone comprises a raised inner portion and a raised outer portion, wherein the raised inner portion is thicker than the raised outer portion. Both the inner and outer portions are thicker than the intermediate zone. On this hitting face, the location of longest characteristic time is offset from a geometric center of the hitting face.

A golf club comprising a hitting face that is further comprising a central zone, an intermediate zone, and a transition zone. The central zone has a first thickness and the intermediate zone, concentric with the central zone has a second thickness; wherein the first thickness is greater than the second thickness. The transition zone is concentric with both the central zone and the intermediate zone, having a tapered thickness to join the central zone and the intermediate zone. The central zone may be substantially elliptical in shape, having a major axis and a minor axis, wherein the major axis is longer than the minor axis. The hitting face may have a location of the longest characteristic time offset from the geometric center of the hitting face.

One or both of the raised portions of the central zone can have the shape of a rhombus. Transition zones with varying thickness can connect the raised inner portion to the raised outer portion and the outer portion to the intermediate zone.

The hitting face may further comprises of a plurality of indentations located at least partially within the intermediate zone of the hitting face, wherein the plurality of indentations has a third thickness that is less than the second thickness.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

As illustrated in the accompanying drawings and discussed in detail below, the present invention is directed to a club head with a longest characteristic time shifted away from the geometric center of the club head. U.S. Pat. No. 6,605,007, which is incorporated herein in its entirety, discloses an improved golf club that also produces a relatively large "sweet zone" or zone of substantially uniform high initial velocity or high coefficient of restitution (COR). Increases or decreases in COR correspond generally but not directly to increases and decreases in the spring-like effect and characteristic time of a golf club head as many of the same design function affect both properties, such as material selection and club hitting face thickness.

Figure 1:
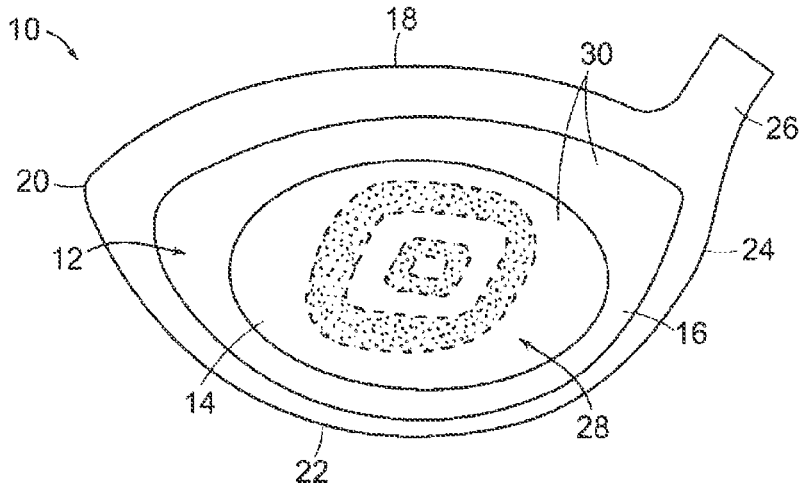
FIG. 1 is a front view of a driver golf club head (not drawn to scale) in accordance with the present invention.

Referring to FIG. 1, one embodiment of a configuration of a hitting face where the location of longest characteristic time is shifted away from the geometric center of hitting face 2 is shown. Hollow metal wood club head 10 has a hitting face 12 which includes a face insert 14 and face support 16. Face insert 14 fits into a similarly shaped opening in face support 16 and is affixed therewithin by any method known in the art, such as by welding. Club head 10 also has crown 18, toe 20, sole 22, heel 24 and hosel 26.

Figure 2:
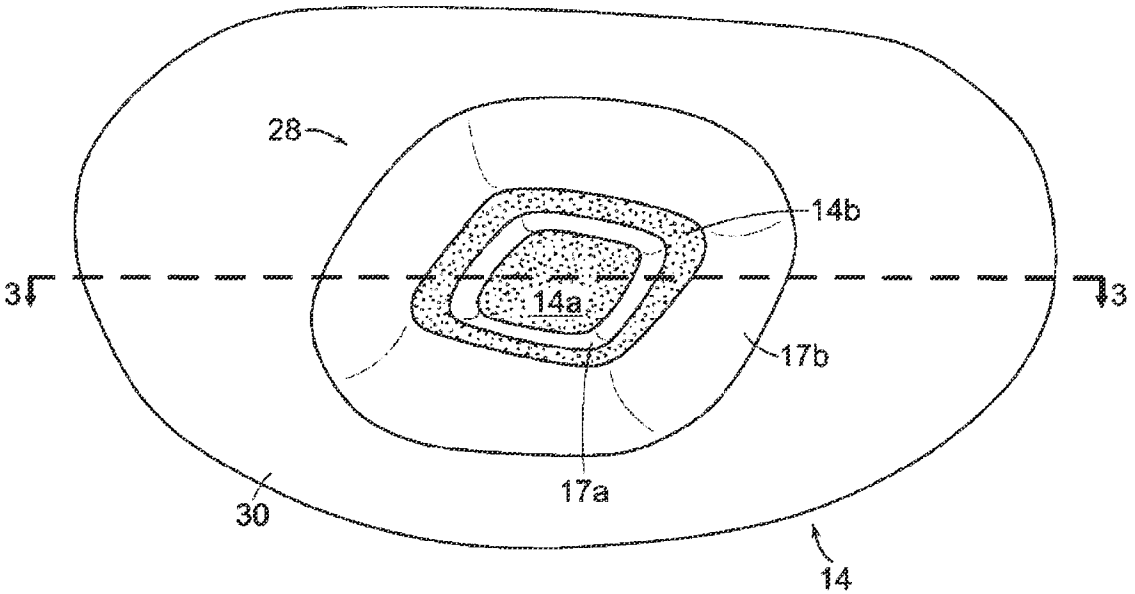
FIG. 2 is a front schematic view of a hitting face insert according to the present Invention.

As shown in FIG. 2, disposed on the inner-cavity-facing surface of face insert 14 is central zone 28, which preferably has a generally elliptical shape. As defined here, the term "rhombus", "rhombi", "ellipse" or "elliptical" refers to non-circular shapes that have discernable major axis and minor axis, and include, but are not limited to, any quadrilateral shapes, geometrical ellipses, quadrilateral shapes with one or more rounded corner(s) and unsymmetrical elliptical shapes. The "major axis" is defined as the axis coinciding with the longest length that can be drawn through the non-circular shapes without intersecting the perimeter of the shapes at more than two locations, i.e., at the start and end points of said length. The "minor axis" is orthogonal to the major axis at or near its midpoint. As used herein, the term "concentric" refers to shapes that substantially encircle or surround other shapes.

Central zone 28 preferably includes a varying thickness profile, where the minor axis of central zone 28 is shorter than the major axis of central zone 28. Central zone 28 is preferably positioned within face insert 14 such that the major axis of central zone 28 is aligned in the direction of the low toe to high heel, so that a sweet spot can be established in the direction of high toe to low heel. This sweet spot advantageously coincides with the typical impact patterns created by golfers as discussed in detail in the parent '221 patent application. As central zone 28 is stiffer than the surrounding zones, the point of longest characteristic time is shifted away from a geometric center of hitting face 12, with the geometric center being preferably located within central zone 28. Central zone 28 is generally more rigid than the rest of hitting face 12 and in a preferred embodiment comprises an inner rhombus/ellipse and an outer rhombus/elliptical ring.

Central zone 28 is comparatively rigid and surrounding intermediate zone 30 is relatively flexible so that upon ball impact intermediate zone 30 includes the area of hitting face 12 less the area of central zone 28. Intermediate zone 30 of face 12 deforms upon impact with a golf ball, i.e., provides a desirable spring-like effect to provide high ball velocity, while central zone 28 is substantially undeformed so that the ball flies on-target. Thus, upon ball impact the deformation of intermediate zone 30 allows central zone 28 to move into and out of club head 10 substantially as a unit. Since central zone 28, which incorporates the geometric center, deforms less than intermediate zone 30, the characteristic time is relocated away from the geometrical center of hitting face 12.

The above effect can be accomplished by providing central zone 28 an aggregate first flexural stiffness and intermediate zone 30 with a second flexural stiffness. Flexural stiffness (FS) is defined as each portion's average elastic modulus (E) times each portion's average thickness (t) cubed or ($FS=Et^3$). The calculation of averages of modulus and thickness is fully disclosed in the parent application and in the '007 patent, which have already been incorporated by reference in their entireties. The determination of FS when the thickness varies such as in the present invention or when the material is anisotropic is also fully discussed in the parent patent application and in the '007 patent.

Since the flexural stiffness is a function of material and thickness, the following techniques can be used to achieve the substantial difference between the flexural stiffness of central zone 28 and intermediate zone 30: 1) different materials can be used for each portion, 2) different thicknesses can be used for each portion, or 3) a combination of different materials and thickness can be used for each portion. For example, in a preferred embodiment, the thickness of central zone 28 is greater than the thickness of intermediate zone 30 and the material for both portions is the same so that the FS of central zone 28 is greater than the FS of intermediate zone 30. Central zone 28 may have a uniform thickness, or the thickness may vary.

Preferably, the ratio of FS (28—aggregate) to FS (30) is at least 1.2, preferably at least 1.5, more preferably 2.0. The required flexural stiffness ratio may also be obtained through the use of structural ribs, reinforcing plates, thickness parameters or by the double-rhombus shape shown in FIG. 1. U.S. Pat. No. 7,029,403 and the '007 patent describe in detail a preferred range of ratios of flexural stiffness between central zone 28 and intermediate zone. The '403 patent is also incorporated herein by reference in its entirety.

The performance of hitting face 12 is optimized over the entire area of face 12 instead of at or around the geometric center of hitting face 12. As USGA club conformance standards using the pendulum test method described herein are based upon the characteristic time, i.e., the duration of contact between a probe and the club hitting face, only at the geometric center of the hitting face, hitting face 12 may have locations having longer characteristic times while staying within the USGA rules. This shifting of the location of longest characteristic time is found on hitting face structures that raise the stiffness of central zone 28 or, similarly, decreases the stiffness of intermediate zone 30. Several examples of such hitting face configurations are discussed below and further described or disclosed in the parent '221 application, as well as the '403 and'007 patents.

Figure 3:
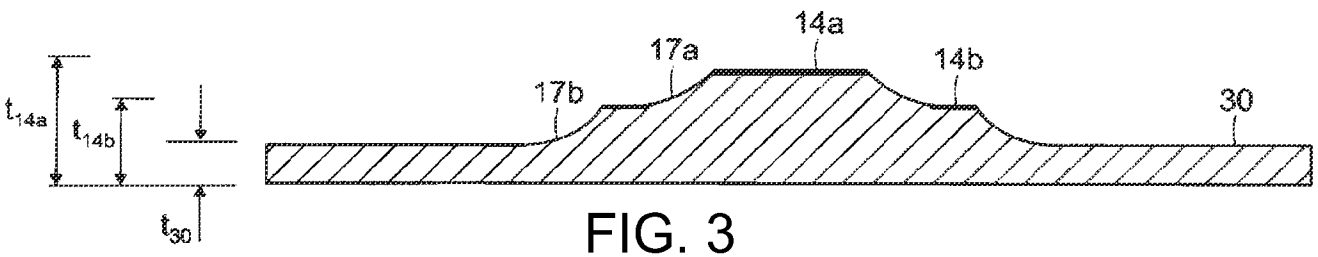
FIG. 3 is a cross-sectional view of the hitting face of FIG. 2 taken along line 3-3 thereof.

FIG. 2 shows in more detail face insert 14 of hitting face 12 shown in FIG. 1. Face insert 14 is configured to be inserted into any club head having an opening formed therein to receive face insert 14. In order to increase the FS of the center of face insert 14, inner central zone 14*a* and outer central zone 14*b* are provided on rear of face insert 14. Inner central zone 14*a* has a surface area which is less than the surface area of outer central zone 14*b*, with inner central zone 14*a* connected to outer central zone 14*b* by a first transition zone 17*a*. Preferably, the area occupied by inner central zone 14*a* is between about 10% and about 80% of the area occupied by the outline of outer central zone 14*b*. A second transition zone 17*b* connects outer central zone 14*b* with a portion of intermediate zone 30. As such, when inner central zone 14*a* is stacked onto outer central zone 14*b* which, in turn, is positioned on intermediate zone 30, inner central zone 14*a* and outer central zone 14*b* create a stepped profile as shown in FIG. 3, except for transition zones 17*a* and 17*b*.

Preferably, inner central zone 14*a* and outer central zone 14*b* have similar elliptical shapes, which in this embodiment are shown as rhombi having rounded corners. However, inner central zone 14*a* and outer central zone 14*b* may have the same or different configurations, which may be selected from any known geometric shape. As such, inner central zone 14*a* and outer central zone 14*b* form substantially flat surfaces connected by tapering first transition zone 17*a*. Therefore, the thickest portion of face insert 14 coincides with any point on inner central zone 14*a*. In another embodiment, inner central zone 14*a* may have another configuration, such as rounded, so that the thickest point of face insert 14 is a specific location on inner central zone 14*a*. As such, inner central zone 14*a* has a higher flexural stiffness than the surrounding areas, and, correspondingly, shorter characteristic time. As the point of highest characteristic time will be located on a point of hitting face 12 which has a lower flexural stiffness than inner central zone 14*a*, preferably, inner central zone 14*a* is positioned at or proximate to the geometric center of hitting face 12, so that the point of longest characteristic time is shifted away from the geometric center of hitting face 12.

Preferably, face insert 14 is made by forging, milling, or stamping and forming. In an exemplary process, a malleable metal suitable for use as a hitting face, such as titanium, titanium alloy, carbon steel, stainless steel, beryllium copper, and other formable metals, is heated and then hammered into the desired shape of the face insert. Examples of some appropriate metals include, but are not limited to, titanium 6-4 alloy, titanium 15-3-3-3 alloy, titanium 20-4-1 alloy, and DAT 55 and DAT 55G, titanium alloys available from Daido Steel of Tokyo, Japan. Preferably, face insert 14 is made as a unitary piece, with inner central zone 14*a*, outer central zone 14*b*, and a portion of intermediate zone 30 fashioned from a single plate of material, e.g. by forging. Alternatively, inner central zone 14*a* and outer central zone 14*b* may be made as separate pieces which are then affixed to a plate forming intermediate zone 30 *using* any method known in the art, such as welding, brazing, hot isotonic pressing, using an adhesive, mechanical fixtures, and the like. In such a case, inner central zone 14*a* and outer central zone 14*b* could be made from any material known in the art, such as metals, composites, and the like. For example, it may be desirable to manipulate the center of gravity of the club head by using multiple materials or composites. The benefits of having thickened inner central zone 14*a* and outer central zone 14*b* can be achieved by using a lightweight, relatively stiff material, such as a graphite composite, which sufficiently stiffens inner central zone 14*a* and outer central zone 14*b* but does not significantly increase the weight of hitting face 12.

The material properties of face insert 14 can also be affected by the method chosen to form face insert 14. For example, face insert 14 is preferably stamped or milled from sheet metal after the metal has been cold rolled or cold worked in order to align the crystal grains of the metal. Stamped metal made in this fashion produces a stronger hitting face than other manufacturing techniques. Further, face insert 14 is then positioned within hitting face 12 so that the grain flow pattern of face insert 14 runs in a sole-to-crown direction. Alternatively, the grain flow pattern of face insert 14 may run in a heel-to-toe direction or in a diagonal direction. Other methods known in the art may also be used to manufacture face insert 14, such as forging and casting.

Hitting face 12 in any of the embodiments described above is preferably cast, formed, milled, chemically milled, PM-sintered, or any combination thereof. The body of club 10 is preferably cast. The inner cavity of club head 10 may be empty, or alternatively may be filled with foam or other low specific gravity material. It is preferred that the inner cavity has a volume greater than 150 cubic centimeters, and more preferably greater than 350 cubic centimeters, and most preferably 450 cubic centimeters or more. Preferably, the mass of the inventive club head is greater than 150 grams but less than 230 grams. Further part and manufacturing details and additional test results regarding the COR values of inventive club heads are discussed in detail in the parent '221 application and the '403 and '007 patents.

Table 1 shows how the characteristic time varies between the hitting face of the inventive club and the hitting face of a club made according to an embodiment shown and described in the parent '221 application. The inventive club is a hollow metal wood club head having a hitting face made generally in accordance with the embodiment shown in FIGS. 2 and 3. Both the inner central zone 14*a* and outer central zone 14*b* are rounded-corner rhombi, with the inner central zone positioned substantially over the geometric center of the inventive club hitting face 12.

The exemplary club hitting face is approximately 4.4 mm (0.173 inch) in thickness in the inner central zone ($t_{14a}$), approximately 3.4 mm (0.134 inch) in thickness in the outer central zone ($t_{14b}$), and approximately 2.4 mm (0.094 inch) in thickness in the intermediate zone ($t_{30}$). The inner central zone rhombus sides are each about 2.54 mm long, and the outer central zone rhombus sides are each about 7.94 mm. The flexural stiffness or FS of inner central zone 14*a* is about 85,432; the FS of outer central zone 14*b* is about 39,701; and the FS of intermediate zone 30 is about 13,704. The flexural ratios are as follows:

$$FS(14a)/FS(14b)=2.15$$

$$FS(14b)/FS(30)=2.90$$

$$FS(14a)/FS(30)=6.23$$

Preferably, the FS ratio between the inner central zone to the outer central zone is at least about 1.2, preferably about 1.5 and more preferably at least about 2.0. The FS ratio between the outer central zone to the intermediate zone is at least about 1.2, preferably about 1.5 and more preferably at least about 2.0. The ratio between the inner zone and the intermediate zone is at least about 2.5, more preferably about 3.0 and more preferably about 3.5.

Figure 4:
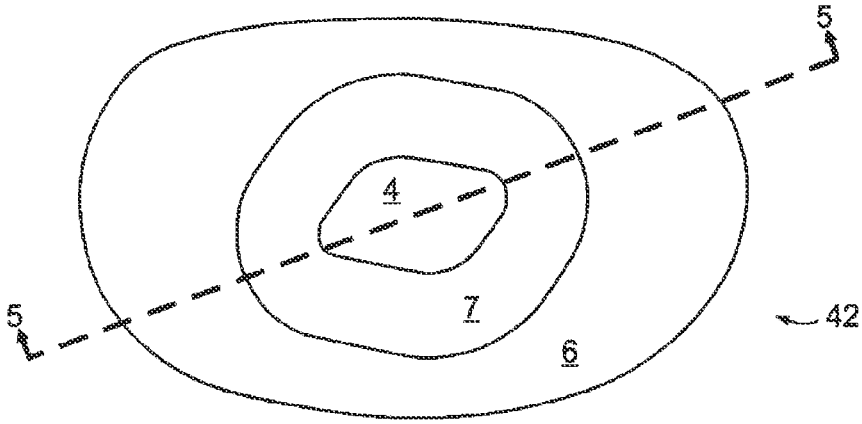
FIG. 4 is a schematic view of a club head showing zones of varying flexural thickness as disclosed in the parent '221 application and corresponds to FIG. 5 thereof.
Figure 5:
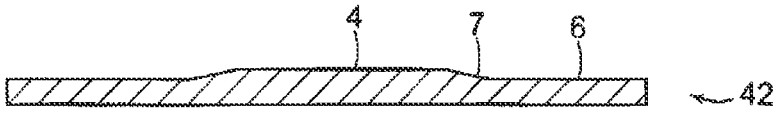
FIG. 5 is a cross-sectional view of the club head of FIG. 4 taken along line 5-5 thereof and corresponds to FIG. 5A of the parent '221 application.

A comparison club is made substantially according to FIG. 4, which corresponds to FIG. 5 from the parent '221 application. The comparison club has a hitting face 42 with a central zone 4 in the shape of a rounded-corner rhombus surrounded by a thinner intermediate zone 6 with a transitional zone 7 having a tapered thickness to join central zone 4 and intermediate zone 6 in a smooth radius. This smooth transition of thicknesses is shown more clearly in FIG. 5, which shows a cross-sectional view of hitting face. Each leg of the rounded-corner rhombus is about 6.35 mm.

Both the inventive club and the comparison club were tested using the USGA pendulum test, where the club head is inserted into a testing apparatus and hit with a weighted pendulum at the geometric center at several different speeds. The length of contact duration between the weighted pendulum and the club head hitting face is measured to determine the characteristic time of the club. In addition to the standard testing at the geometric center, however, the inventive club and the comparison club were tested at several off-center locations to determine characteristic times away from the geometric center of hitting face 42. As such, the overall flexibility of the hitting faces of the inventive club and the comparison club can be determined.

King Cobra M/SPEED 9.0° drivers with stock cast 6-4 Titanium head models were used in the test. One driver has the inventive face insert of FIGS. 2 and 3 and the other drive has the comparison insert of FIGS. 4 and 5 were. Both inserts were cast with 6-4 Titanium and chemically milled. The thickness in the central zone (4) of the comparison insert is about 4.3 mm (0.169 inch) and the thickness of the intermediate zone (6) of the comparison insert is about 2.8 mm (0.110 inch).

TABLE 1

Characteristic Times for Inventive Club, Comparison Club

| Testing Location on Hitting Face | Inventive Club Characteristic Time (μs) | Comparison Club Characteristic Time (μs) | Change in Characteristic Time (μs) |
|---|---|---|---|
| Geometric Center (GC) | 253 | 250 | +3 |
| Horizontally Offset Toward Heel from GC | 266 | 266 | — |
| Horizontally Offset Toward Toe from GC | 250 | 243 | +7 |
| Vertically Above GC, Directly | 250 | 235 | +15 |
| Vertically Below GC, Directly | 252 | 249 | +3 |
| Vertically Above GC, Offset Toward Toe | 256 | 248 | +8 |
| Vertically Below GC, Offset Toward Toe | 243 | 231 | +12 |
| Vertically Above GC, Offset Toward Heel | 271 | 269 | +2 |
| Vertically Below GC, Offset Toward Heel | 262 | 263 | −1 |

As can be seen in Table 1, in both clubs the characteristic time at the geometric center of the hitting face meets the USGA rule of less than 258 microseconds (μs). However, the inventive club is closer to the USGA limit, which means that the inventive club is more flexible at the geometric center than the comparison club. The highest characteristic times were measured toward the heel. Additionally, the characteristic time at nearly every tested location is higher for the inventive club than for the comparison club or substantially the same for both clubs. In other words, the inventive club face is able to flex more than the comparison club. As such, the spring-like effect of the inventive club is enhanced as compared to the comparison club, which should yield greater carry distances, even though both clubs satisfy USGA hitting face flexibility rules.

Figure 6:
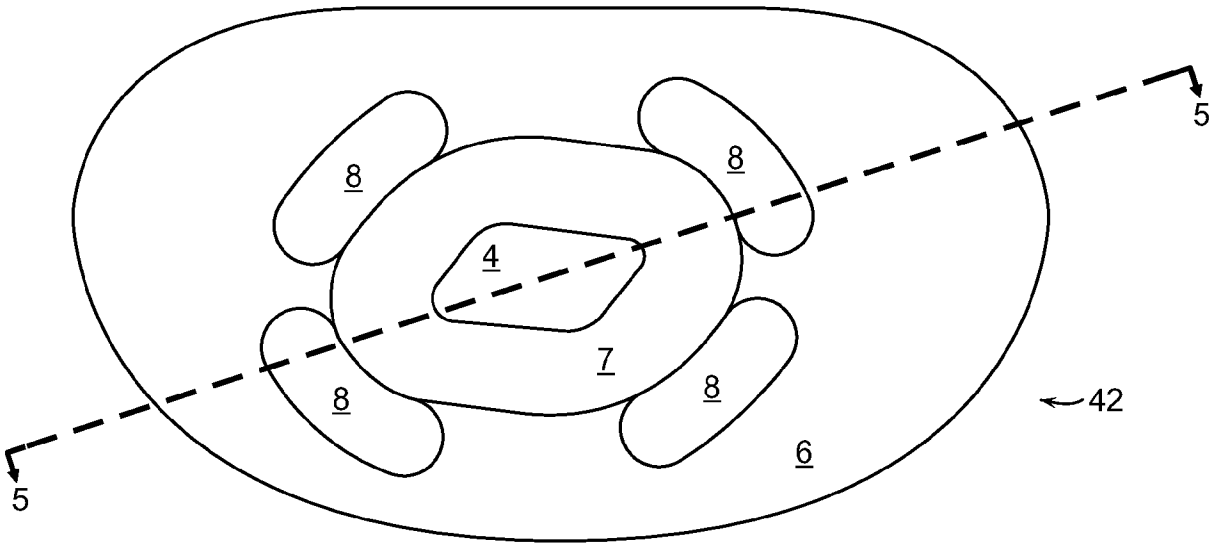
FIG. 6 is a front schematic view of a hitting face insert according to an alternative embodiment of the present invention.

FIG. 6 of the accompanying drawings shows a schematic view of the hitting face 42 of a club head illustrating zones of varying flexural thickness in accordance with an alternative embodiment of the present invention. Hitting face 42, as shown in the current exemplary embodiment of the present invention, may generally contain a plurality of indentations 8, located within the intermediate zone 6, circumferentially surrounding the transition zone 7. Having a plurality of indentations 8 that circumferentially surrounds the transition zone 7 of the hitting face 42 may improve the performance of a golf club head by allowing more of the perimeter of the hitting face 42 to be thinned. As previously discussed, having the perimeter region of the hitting face 42 thinner allows the central zone 4 that is made thicker to move in and out of the hitting face 42 upon impact with a golf ball; resulting in an increase in COR that is also more uniformly distributed across the entire hitting face 42.

The plurality of indentations 8 shown in this exemplary embodiment of the present invention may generally be kidney bean shaped and may be strategically placed within the intermediate zone 6 around an external perimeter of the transition zone 7. Having the plurality of indentations 8 within the intermediate zone 6 may serve to the alter the flexural stiffness of the intermediate zone 6 by making the intermediate zone 6 even thinner than previously possible, decreasing the flexural stiffness of the intermediate zone 6. Although FIG. 6 shows four indentations 8 located around the perimeter of the transition zone 7, various other iterations of indentations 8 with various instances of indentations 8 having various sizes and various shapes may also be used so long as it decreases the flexural stiffness of the intermediate zone 6 without departing from the scope and content of the present invention. In the current exemplary embodiment shown in FIG. 6, the plurality of indentations are strategically placed at the four corners of the elliptical shaped rhombus transition zone 7, creating a thinned region around the perimeter of the transition zone 7. More specifically, the plurality of indentations 8 may be placed at a high heel, a low heel, a high toe, and a low toe portion of the perimeter of the transition zone 7; however various other locations of the indentations 8 may be used so long as it provides a lower flexural stiffness within the intermediate zone 6 without departing from the scope and content of the present invention.

It is also worth noting here in this exemplary embodiment the percentage the total surface area within the intermediate zone 6 that is taken up by the plurality of indentations 8 may be relevant in adjusting the ultimate flexural stiffness of the hitting face 42. Hence, in order to generate a greater change in flexural stiffness between the zones, the indentations 8 could comprise of greater than about 20% and less than about 80% of the back surface area occupied by the intermediate zone 6, more preferably greater than about 25% and less than about 75% of the back surface area occupied by the intermediate zone 6, and most preferably greater than about 30% and less than about 70% of the back surface area occupied by the intermediate zone 6.

Finally, in order to achieve a noticeable difference in the flexural stiffness and performance properties of the hitting face 42, a significant portion of the engagement region between the intermediate zone 6 and the transition zone 7 may need to be covered by thinned indentations 8. Hence, in order to achieve that goal, greater than about 60% of the perimeter of the transition zone 7 may contain an indentation 8, more preferably greater than about 70%, and most preferably greater than about 75% without departing from the scope and content of the present invention. It should be recognized here that the indentations may generally cover less than 100% of the engagement region between the intermediate zone and the transition zone, as the benefit of having a thinner face while maintaining durability is lost if the entire engagement region between the intermediate zone 6 and the transition 7 is filled with indentations 8 that sacrifices structural integrity of the hitting face 42.

Hitting face 42 in accordance with this alternative embodiment shown in FIG. 6 may have a central zone 4 having a first thickness, an intermediate zone 6 having a second thickness, and a transition zone 7 connecting the central zone 4 and the intermediate zone 6. Intermediate zone 7, as shown in the current exemplary embodiment, may generally have a tapered thickness to join the central zone 4 and the intermediate zone 6 in a smooth radius. The tapered thickness of intermediate zone 7 may more clearly be shown below in FIG. 7, which shows a cross-sectional view of the hitting face 42 taken along cross-sectional line 5-5. The plurality of indentations 8 shown here in this current exemplary embodiment may generally thin out the intermediate zone 6 of the hitting face 42, allowing even more movement of the central zone 4 and the transition zone 7 upon impact with a golf ball; further increasing the performance capabilities of the hitting face 42 of the golf club.

Figure 7:
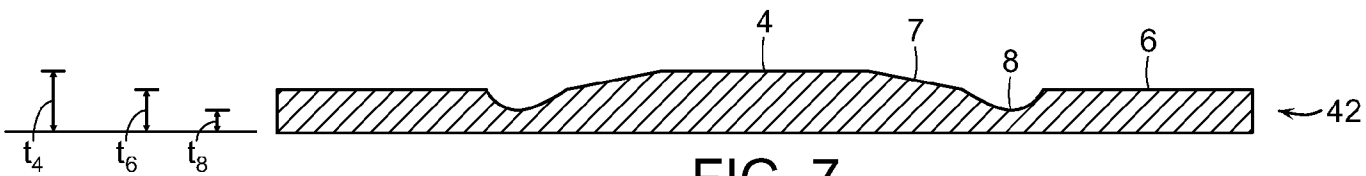
FIG. 7 is a cross-sectional view of the hitting face of FIG. 6, taken along line 5-5 thereof.

The cross-sectional view of the hitting face 42 shown in FIG. 7 shows more clearly the various thicknesses created by the inner zone 4, the intermediate zone 6, the transition zone 7, and the indentations 8. More specifically, the inner zone 4 may generally be the thickest portion of the hitting face 42 with a first thickness t4 that may be greater than about 3.4 mm, more preferably greater than about 3.6 mm, and most preferably greater than about 3.8 mm in order to withstand the tremendous impact forces with a golf ball. Because the majority of the impact forces are absorbed by the central zone 4, the intermediate zone 6 may generally have a second thickness t6 that is less than the first thickness t4. More specifically, intermediate zone 6 may generally have a second thickness t6 that is less than the first thickness t4 of the central zone 4 being greater than about 2.0 mm and less than about 3.0 mm, more preferably greater than about 2.2 mm and less than about 2.8 mm, most preferably greater than about 2.4 mm and less than about 2.6 mm. The transition zone 7, as shown in the current exemplary embodiment may generally have a tapered thickness to join the central zone 4 and the intermediate zone 6. The transition zone 7, although shown in FIG. 7 with a constantly decreasing in thickness from the central zone 4 towards the intermediate zone 6, may have a curved cross-sectional profile to achieve different flexural stiffness bending profiles without departing from the scope and content of the present invention.

The plurality of indentations 8, shown in the current exemplary embodiment in FIG. 7 may generally have a third thickness t8 that is even less than the first thickness t4 and the second thickness t6. Because of the semi-circular cross-sectional profile of the indentations 8, the third thickness t8 may generally be variable, with a minimum thickness of greater than about 1.0 mm, more preferably greater than about 1.25 mm, most preferably greater than about 1.5 mm. In order to create a sufficiently thin enough cross-section at the locations where the indentations 8 present, the indentations may generally have a radius of curvature of less than about 25.0 mm, more preferably less than about 20.0 mm, and most preferably less than about 18.0 mm, all without departing from the scope and content of the present invention.

Figure 8:
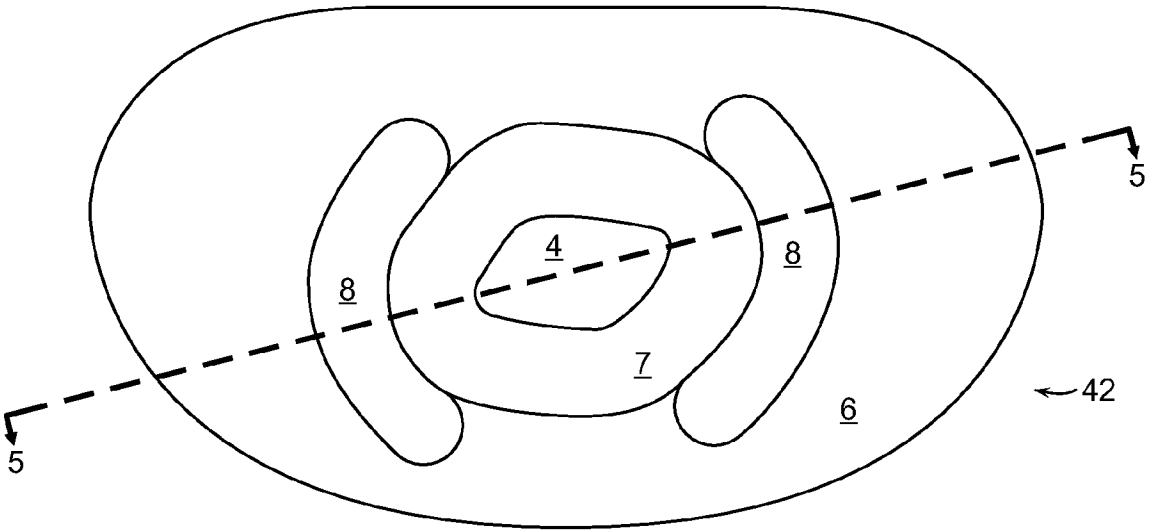
FIG. 8 is a front schematic view of a hitting face insert according to an alternative embodiment of the present invention.

FIG. 8 of the accompanying drawings shows a schematic view of the hitting face 42 of a club head illustrating zones of varying flexural thickness in accordance with an alternative embodiment of the present invention. In this alternative embodiment of the present invention shown in FIG. 8, hitting face 42 may have two elongated kidney bean shaped indentations 8 across the heel portion and the toe portion of the perimeter of the transition zone 7. The plurality of indentations 8, similar to the plurality of indentations 8 discussed above, may serve to improve the performance of the hitting face 42 by decreasing the flexural stiffness of the intermediate zone 6, allowing the central zone 4 to achieve a higher COR across a greater portion of the hitting face 42. It should be noted that in this current exemplary embodiment, the indentations 8 may cover a greater percentage of the engagement portion between the transition zone 7 and the intermediate zone 6 to create even more differences in the flexural stiffness in the different zones. More specifically the plurality of indentations 8 shown in FIG. 8 may cover greater than about 70% of the perimeter of the transition zone 7, more preferably greater than about 80%, and most preferably greater than about 85% without departing from the scope and content of the present invention.

Figure 9:
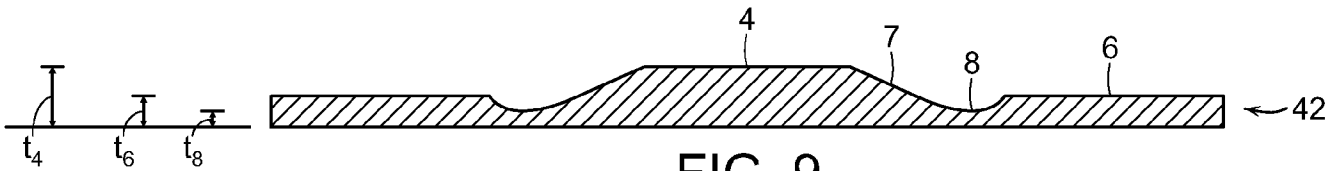
FIG. 9 is a cross-sectional view of the hitting face of FIG. 8, taken along line 5-5 thereof.

FIG. 9 of the accompanying drawings shows a cross-sectional view of the hitting face 42 taken along cross-sectional line 5-5 shown in FIG. 8, illustrating the how the plurality of indentations 8 interfaces with the transition zone 7 and the intermediate zone 6. More specifically, because the plurality of indentations 8 appears like circular channels in this cross-sectional view, they may have variable thicknesses. It should be noted here that in addition to the constant profile of the indentation 8 shown here in FIG. 9, the channels created by the plurality of indentations 8 may have different thicknesses with various radius of curvature to achieve various flexural stiffness characteristics without departing from the scope and content of the present invention.

Figure 10:
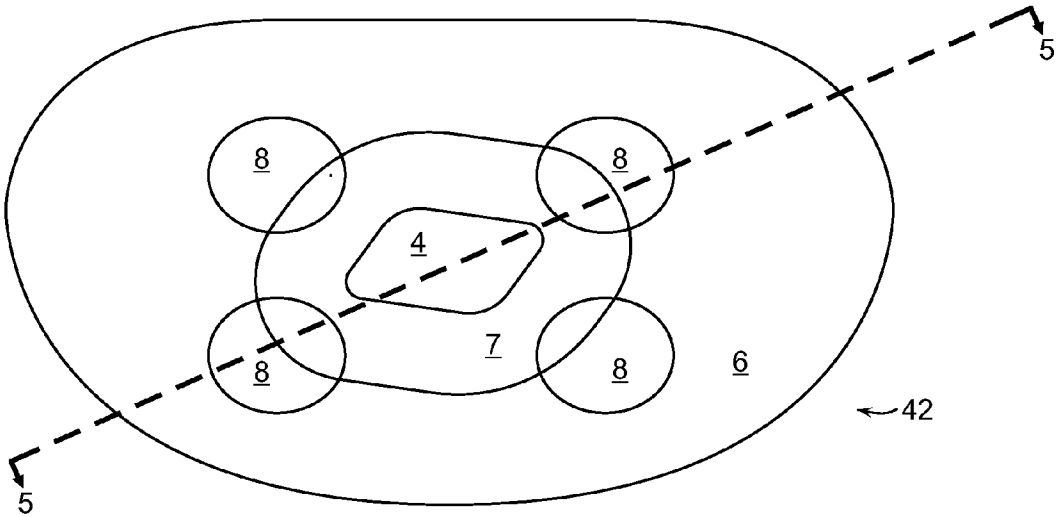
FIG. 10 is a front schematic view of a hitting face insert according to an alternative embodiment of the present invention.

FIG. 10 of the accompanying drawings shows a further alternative embodiment of the present invention wherein the hitting face 42 may have a plurality of indentations 8 be more circular in shape and having them placed at a location that spans across the transition zone 7 and the intermediate zone 6. Having the plurality of indentations 8 be more circular shaped may be preferred in this alternative embodiment to help adjust the amount of flexural stiffness of the hitting face to be within the USGA limits on the maximum COR allowed for a golf club head. More specifically, because the circular shaped indentations 8 may not cover as much area around the perimeter of the transition zone 7 as a kidney shaped indentation 8 would, it could potentially offer a lower flexural stiffness. More specifically, the plurality of indentations 8 shown here may cover less than about 60% of the perimeter of the transition zone 7 that engages an indentation 8, more preferably less than about 50%, and most preferably less than about 45% without departing from the scope and content of the present invention without departing from the scope and content of the present invention.

Figure 11:
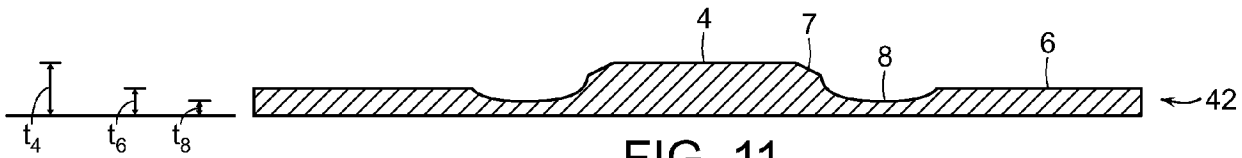
FIG. 11 is a cross-sectional view of the hitting face of FIG. 10, taken along line 5-5 thereof.

Because of the lowered flexural stiffness that could potentially result from the more circular shaped indentations 8, the current exemplary embodiment of the present invention places the circular indentations 8 at the intersecting region between the transition zone 7 and the intermediate zone 6. As it can be seen from the cross-sectional view of the hitting face 42 taken across cross-sectional line 5-5 in FIG. 11, placing the indentations 8 at the intersecting regions between the transition zone 7 and the intermediate zone 6 causes a dramatic decrease in thickness from the first thickness t4 to the third thickness t8. Such a dramatic decrease in thickness of the hitting face 42 allows for a more direct and immediate flexural stiffness change, allowing this embodiment of the present invention to recapture some of the COR that could be lost due to the circular indentations 8 that engages less of the perimeter of the transition zone 7.

Figure 12:
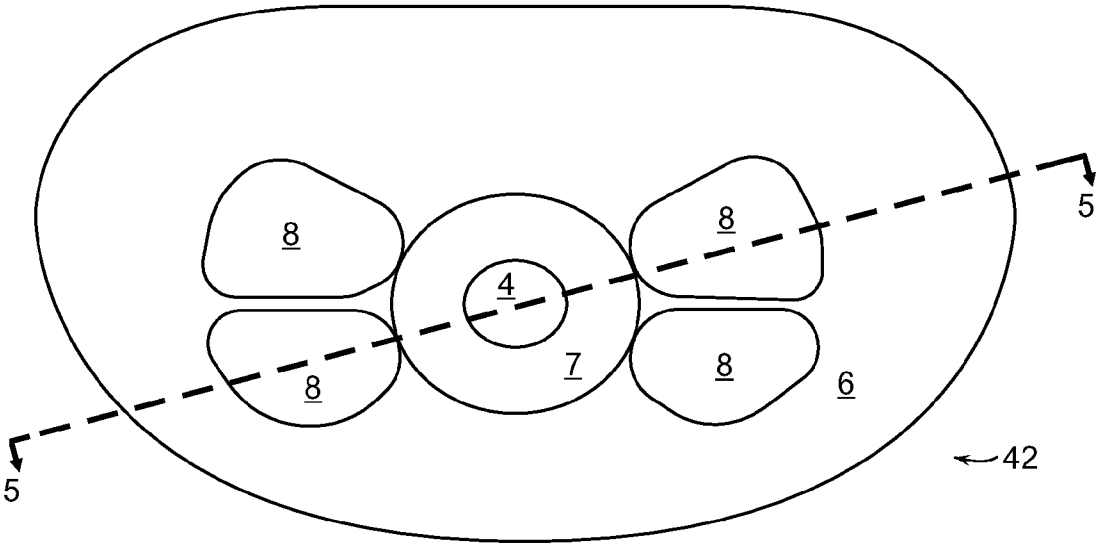
FIG. 12 is a front schematic view of a hitting face insert according to an alternative embodiment of the present invention.

FIG. 12 of the accompanying drawings shows a further alternative embodiment of the present invention wherein the plurality of indentations 8 may take on a different shape to achieve as a different way to achieve the same goal of thinning out intermediate zone 6 around the perimeter of the transition zone 7 to increase the COR of the hitting face 42 without departing from the scope and content of the present invention. The flower pedal shaped indentations 8 shown in this exemplary embodiment of the present invention creates an extended thinned portion in the intermediate zone 6, yielding a larger percentage of the surface area of the intermediate zone 6 to be covered by the indentations 8. In this embodiment of the present invention, the indentations 8 could comprise of greater than about 20% and less than about 80% of the area occupied by the intermediate zone 6, more preferably greater than about 25% and less than about 75% of the area occupied by the intermediate zone 6, and most preferably greater than about 30% and less than about 70% of the area occupied by the intermediate zone 6. This variation may offer a completely different flexural stiffness profile within the hitting face 42 that is different from all prior embodiments of the present invention wherein the indentations closely track the perimeter of the transition zone 7.

Figure 13:
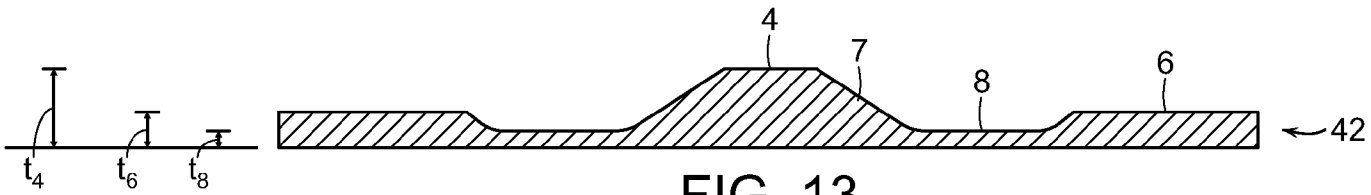
FIG. 13 is a cross-sectional view of the hitting face of FIG. 12, taken along line 5-5 thereof.

FIG. 13 of the accompanying drawings shows a cross-sectional view of the hitting face 42 shown in FIG. 12 taken along cross-sectional line 5-5. In this cross-sectional view of the hitting face 42 shown in FIG. 12, it can be seen that the indentations 8 that encompasses such a large portion of the intermediate zone 6 may create an even more dramatic drop in thicknesses between the thickness t4 at the central zone 4 and the thickness t8 at the indentations 8 of the hitting face. This dramatic drop in the thickness of the different zones could promote an increased flexural stiffness ratio between the different zones, yielding hitting face 42 with a different performance.

Figure 14:
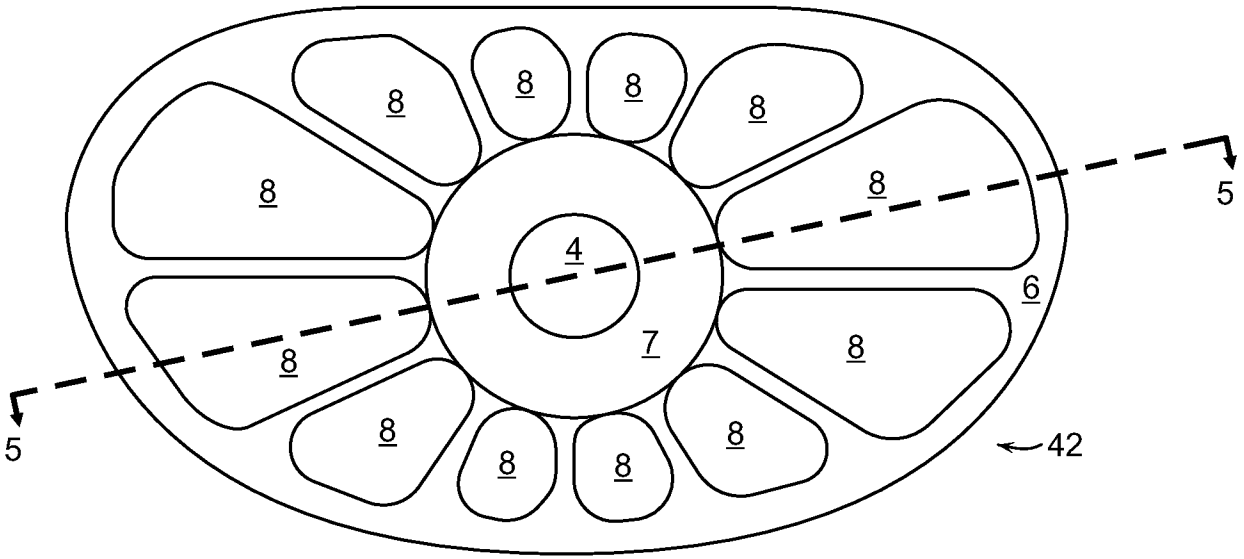
FIG. 14 is a front schematic view of a hitting face insert according to an alternative embodiment of the present invention.
Figure 15:
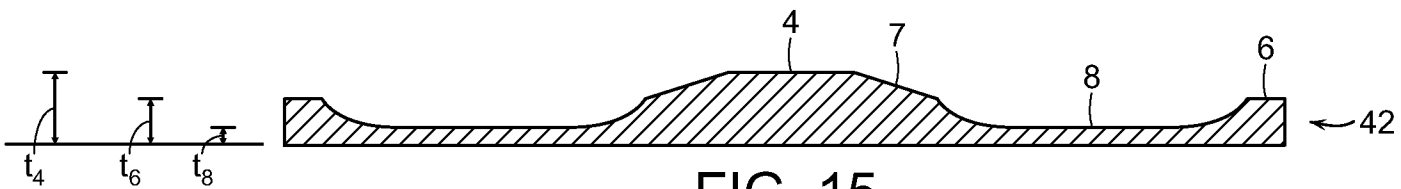
FIG. 15 is a cross-sectional view of a hitting face of FIG. 14, taken along line 5-5 thereof.

FIG. 14 of the accompanying drawings shows a further alternative embodiment of the present invention wherein the plurality of indentations 8 may encompass a significant portion of the intermediate portion 6 of the hitting face 42. More specifically, the indentations 8 could comprise of greater than about 75% of the total surface area occupied by the intermediate zone 6, more preferably greater than about 80% of the total surface area occupied the intermediate zone 6, and most preferably greater than about 85% of the total surface area occupied by the intermediate zone 6 without departing from the scope and content of the present invention. Similar to the discussion above, this alternative arrangement of the plurality of indentations could offer different performance characteristic than the various embodiments discussed above. FIG. 15 of the accompanying drawings shows a cross-sectional view of the hitting face 42 shown in FIG. 14 taken along cross-sectional line 5-5. This cross-sectional view of the hitting face 42 shown by FIG. 15 shows the various thicknesses t4, t6, and t8, corresponding with the thickness of the central zone 4, the thickness of the intermediate zone 6, and the thickness at the indentations 8 respectively.

Figure 16:
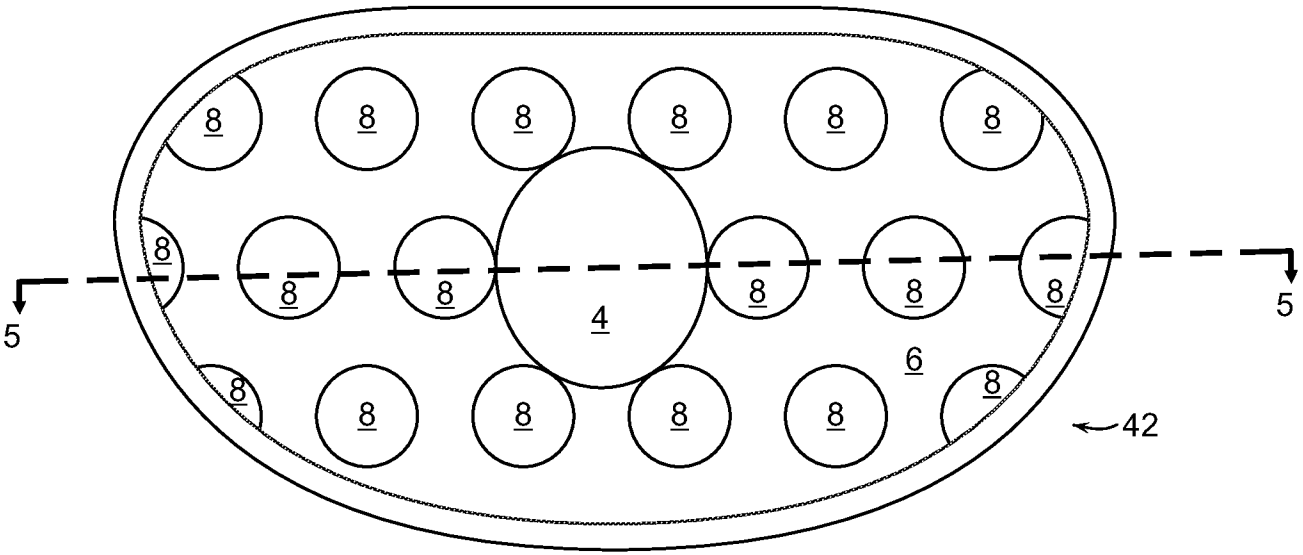
FIG. 16 is a front schematic view of a hitting face insert according to an alternative embodiment of the present invention.
Figure 17:
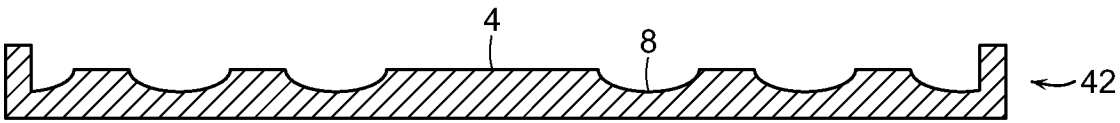
FIG. 17 is a cross-sectional view of a hitting face of FIG. 16, taken along line 5-5 thereof.

FIGS. 16 and 17 of the accompanying drawings shows a further alternative embodiment of the present invention wherein the plurality of indentations could be scattered around the central zone 4 utilizing circular indentations 8. More specifically, this alternative embodiment of present invention may utilize only the plurality of indentations to adjust the flexural stiffness variations within the hitting face 42, without the need for a variable thickness at the central zone 4. This alternative embodiment of the present invention may be preferred in certain situations where a different flexural stiffness across the hitting face is desired, but variable face thickness geometry is not used. Hence it can be seen from FIGS. 16 and 17 the plurality of indentations 8 may be used without the need for a variable face thickness without departing from the scope and content of the present invention.

While various descriptions of the present invention are described above, it should be understood that the various features of each embodiment could be used alone or in any combination thereof. Therefore, this invention is not to be limited to only the specifically preferred embodiments depicted herein. Further, it should be understood that variations and modifications within the spirit and scope of the invention might occur to those skilled in the art to which the invention pertains. For example, any hitting face structure that increases stiffness at the geometric center as compared to the hitting face perimeter is appropriate, so the present invention is not limited to only those structures disclosed herein. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims. All publications discussed herein, including but not limited to patents, patent applications, articles, and books, are incorporated by reference in their entireties.

The invention claimed is:

1. A golf club head comprising:

a hitting face comprising, a central zone having a first thickness;

an intermediate zone concentric with said central zone having a second thickness, wherein said first thickness is greater than said second thickness; and a transition zone concentric with both said central zone and said intermediate zone circumferentially placed between said central zone and said intermediate zone having a tapered thickness to join said central zone and said intermediate zone, wherein a location of a longest characteristic time is offset from a geometric center of said hitting face, wherein said central zone is substantially elliptical in shape, having a major axis and a minor axis; said major axis is longer than said minor axis.

2. The golf club head of claim 1, wherein said intermediate zone further comprises a plurality of indentations, said plurality of indentations having a third thickness, wherein said third thickness is less than said second thickness.

3. The golf club head of claim 2, wherein said plurality of indentations occupies greater than about 75% of an area occupied by said intermediate zone.

4. The golf club head of claim 2, wherein said plurality of indentations occupies greater than about 20% and less than about 80% of an area occupied by said intermediate zone.

5. The golf club head of claim 4, wherein said plurality of indentations occupies greater than about 25% and less than about 75% of said area occupied by said intermediate zone.

6. The golf club head of claim 5, wherein said plurality of indentations occupies greater than about 30% and less than about 70% of said area occupied by said intermediate zone.

7. The golf club head of claim 4, wherein said plurality of indentations are completely located within said intermediate zone.

8. The golf club head of claim 7, wherein a ratio between a flexural stiffness of said central zone to a flexural stiffness of said intermediate zone is at least about 1.2.

9. The golf club head of claim 8, wherien said ratio between said flexural stiffness of said central zone to said flexural stiffness of said intermediate zone is at least about 1.5.

10. The golf club head of claim 9, wherein said ratio between said flexural stiffness of said central zone to said flexural stiffness of said intermediate zone is at least about 2.0.

11. The golf club head of claim 10, wherein at least one of said plurlaity of indentations spans across said intermediate zone as well as said transition zone.

12. A golf club head comprising:

a hitting face comprising, a central zone located substantially near a geometric center of said hitting face;

an intermediate zone concentric with said central zone further comprising a plurality of indentations at a rear surface of said hitting face, wherein said plurality of indentations circumferentially surround said central zone;

wherein a thickness of said hitting face at said central zone is greater than a thickness of said hitting face at said plurality of indentations of said intermediate zone; and wherein a location of a longest characteristic time is offset from a geometric center of said hitting face.

13. The golf club head of claim 12, wherein said plurality of indentations occupies greater than about 20% and less than about 80% of an area occupied by said intermediate zone.

14. The golf club head of claim 13, wherein said plurality of indentations occupies greater than about 25% and less than about 75% of said area occupied by said intermediate zone.

15. The golf club head of claim 14, wherein said plurality of indentations occupies greater than about 30% and less than about 70% of said area occupied by said intermediate zone.

16. A golf club head comprising:

a hitting face comprising, a central zone having a first thickness;

an intermediate zone concentric with said central zone having a second thickness; wherein said intermediate zone further comprises a plurality of indentations, said plurality of indentations having a third thickness, and a transition zone concentric with both said central zone and said intermediate zone circumferentially placed between said central zone and said intermediate zone having a tapered thickness to join said central zone and said intermediate zone, wherein said first thickness is greater than said second thickness and said third thickness is less than said second thickness; and wherein a location of a longest characteristic time is offset from a geometric center of said hitting face.

17. The golf club head of claim 16, wherein said plurality of indentations are placed around an external perimeter of said transition zone.

18. The golf club head of claim 17, wherein said plurality of indentations engages greater than about 60% of said external perimeter of said transition zone.

19. The golf club head of claim 18, wherein said plurality of indentations engages greater than about 70% of said external perimeter of said transition zone.

20. The golf club head of claim 19, wherein said plurality of indentations engages greater than about 75% of said external perimeter of said transition zone.

21. The golf club head of claim 17, wherein said plurality of indentations occupies greater than about 20% and less than about 80% of an area occupied by said intermediate zone.

22. The golf club head of claim 21, wherein said central zone has a generally elliptical shape, with a major axis that aligns substantially in the direction of high heel to low toe, and positioned at a geometric center of said hitting face.

* * * * *